US012195301B2

(12) United States Patent
Tonami

(10) Patent No.: US 12,195,301 B2
(45) Date of Patent: Jan. 14, 2025

(54) MEDIUM CONVEYING APPARATUS

(71) Applicant: PFU Limited, Ishikawa (JP)

(72) Inventor: Norifumi Tonami, Ishikawa (JP)

(73) Assignee: PFU LIMITED, Ishikawa (JP)

( * ) Notice: Subject to any disclaimer, the term of this patent is extended or adjusted under 35 U.S.C. 154(b) by 166 days.

(21) Appl. No.: 17/833,328

(22) Filed: Jun. 6, 2022

(65) Prior Publication Data

US 2023/0010583 A1 Jan. 12, 2023

(30) Foreign Application Priority Data

Jul. 6, 2021 (JP) ..... 2021-112287

(51) Int. Cl.
*B65H 9/04* (2006.01)
*B65H 1/04* (2006.01)
*B65H 1/12* (2006.01)

(52) U.S. Cl.
CPC ..... *B65H 9/04* (2013.01); *B65H 1/04* (2013.01); *B65H 1/12* (2013.01); *B65H 2404/743* (2013.01); *B65H 2405/1144* (2013.01)

(58) Field of Classification Search
CPC .... B65H 2405/1144; B65H 2405/1142; B65H 2405/11425; B65H 2405/324
See application file for complete search history.

(56) References Cited

U.S. PATENT DOCUMENTS 8,528,892 B2 9/2013 Nakamura et al.
9,216,867 B2 * 12/2015 Aoyama ..... B65H 1/04
10,351,367 B2 * 7/2019 Barmaki ..... B65H 3/44
10,678,179 B2 * 6/2020 Maeda ..... G03G 15/6514
11,097,911 B2 8/2021 Yoshita
2012/0187622 A1 * 7/2012 Kamichi ..... B65H 3/44 271/171
2015/0097329 A1 * 4/2015 Ukai ..... B65H 1/04 271/9.12
2019/0322478 A1 * 10/2019 Yoshita ..... B65H 1/02

FOREIGN PATENT DOCUMENTS

JP 2004010316 A * 1/2004
JP 2009-143709 A 7/2009
JP 2012-144315 A 8/2012
WO 2018/131117 A1 7/2018

OTHER PUBLICATIONS

Translation of JP '316 (Year: 2024).*

* cited by examiner

*Primary Examiner* — Howard J Sanders
(74) *Attorney, Agent, or Firm* — Rimon P.C.

(57) ABSTRACT

A medium conveying apparatus includes a tray, and a side guide in which a side guide surface opposing to an end face of a medium placed on the tray is formed, wherein the side guide includes a side guide main body that is supported by the tray, and a movable member that is supported by the side guide main body so as to be stored and expanded, a height of the movable member relative to the tray is equal to a first height that is higher than a height of the side guide main body relative to the tray when the movable member is expanded, and is equal to a second height that is lower than the first height when the movable member is stored, and a notch is formed on the movable member such that a depression is formed on the side guide surface when the movable member is expanded.

9 Claims, 14 Drawing Sheets

MEDIUM CONVEYING APPARATUS

CROSS-REFERENCE TO RELATED APPLICATION

This application is based upon and claims the benefit of priority of the prior Japanese Patent Application No. 2021-112287, filed on Jul. 6, 2021, the entire contents of which are incorporated herein by reference.

FIELD

The embodiment discussed herein is related to a medium conveying apparatus.

BACKGROUND

There is a known medium conveying apparatus that includes a side guide that is provided on a tray and that prevents an inclined movement of a medium fed in an inclined manner (International Publication Pamphlet No. WO 2018/131117, Japanese Laid-open Patent Publication No. 2009-143709, and Japanese Laid-open Patent Publication No. 2012-144315). The medium conveying apparatus is able to be reduced in size as a result of the tray being stored, and thus, is able to be stored in a small space.

This type of medium conveying apparatus is able to be reduced in size as a result of reduction in the space in which the tray is stored by reducing the space in which the side guide is stored. However, in this type of medium conveying apparatus, when the height of the side guide is formed to be low, a problem that a medium placed on the tray sometimes climbs over the side guide easily occurs.

SUMMARY

According to an aspect of an embodiment, a medium conveying apparatus includes a tray that is rotatably supported by a main body so as to be stored and unfolded, and a side guide on which a side guide surface opposing to an end face of a medium placed on the tray is formed, wherein the side guide includes a side guide main body that is supported by the tray, and a movable member that is supported by the side guide main body so as to be stored and expanded, a height of the movable member relative to the tray is equal to a first height that is higher than a height of the side guide main body relative to the tray when the movable member is expanded, and is equal to a second height that is lower than the first height when the movable member is stored, and a notch is formed on the movable member such that a depression is formed on the side guide surface when the movable member is expanded.

The object and advantages of the disclosure will be realized and attained by means of the elements and combinations particularly pointed out in the claims.

It is to be understood that both the foregoing general description and the following detailed description are exemplary and explanatory and are not restrictive of the disclosure.

DESCRIPTION OF EMBODIMENTS

Figure 1:
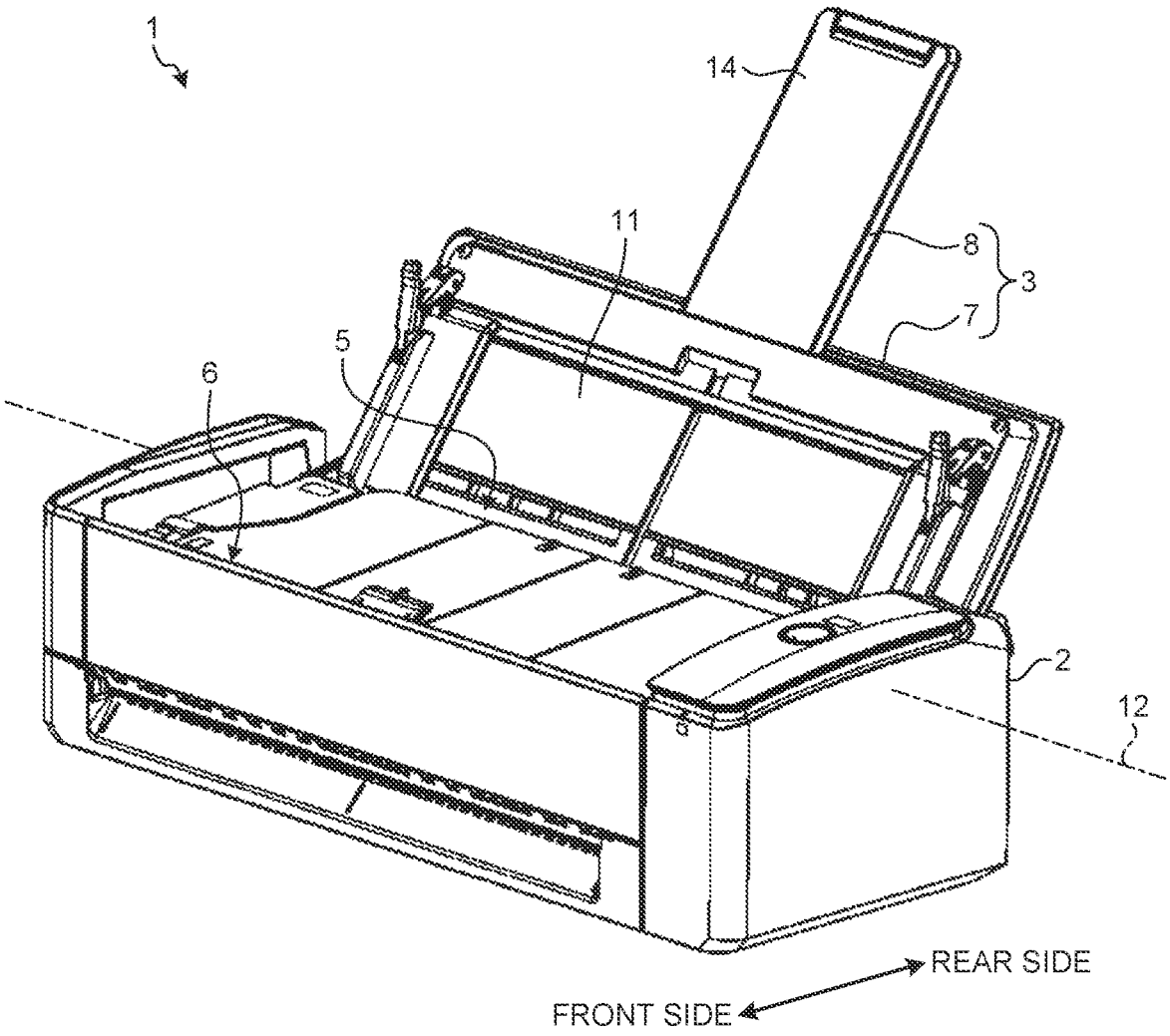
FIG. 1 is a perspective view illustrating an image reading apparatus provided with a medium conveying apparatus according to an embodiment.

Preferred embodiments of a medium conveying apparatus disclosed in the present disclosure will be explained below with reference to the accompanying drawings. Furthermore, the technology of the present disclosure is not limited to the embodiments. Furthermore, in the description below, the same reference numerals are assigned to the same components and descriptions of overlapping portions will be omitted.

Embodiment

As illustrated in FIG. 1, a medium conveying apparatus according to the embodiment is provided in an image reading apparatus 1. FIG. 1 is a perspective view illustrating the image reading apparatus 1 provided with the medium conveying apparatus according to the embodiment. The image reading apparatus 1 includes a medium conveying apparatus main body 2 and a paper feed tray 3. The medium conveying apparatus main body 2 is formed in a substantially box shape. The medium conveying apparatus main body 2 is placed on an installation surface on which the image reading apparatus 1 is installed. A paper feed port 5 and a paper ejection port 6 are formed in the medium conveying apparatus main body 2. The paper feed port 5 is formed on the rear side of the medium conveying apparatus main body 2. The paper ejection port 6 is formed on the front side and the upper side of the medium conveying apparatus main body 2. A conveying path, which is not illustrated, is formed inside the medium conveying apparatus main body 2.

The image reading apparatus 1 further includes a conveying unit and a reading unit that are not illustrated. The conveying unit supplies one of a plurality of media inserted in the paper feed port 5 to the conveying path. The conveying unit further conveys the medium supplied to the conveying path along the conveying path, and ejects the medium, which has been conveyed along the conveying path, from the paper ejection port 6 to an exterior of the medium conveying apparatus main body 2. The reading unit captures an image of the medium conveyed along the conveying path.

The paper feed tray 3 includes a paper feed tray main body 7 and a paper feed tray extension member 8. The paper feed tray main body 7 is formed in a plate shape. A paper feed tray placement surface 11 is formed on the paper feed tray main body 7. A storage space for storing therein the paper feed tray extension member 8 is formed inside the paper feed tray main body 7. The paper feed tray main body 7 is supported by the medium conveying apparatus main body 2 so as to be rotatable about a rotation axis 12. The rotation axis 12 is parallel to the plane which the installation surface where the image reading apparatus 1 is installed is along, and is parallel to the plane which the paper feed tray placement surface 11 is along. The paper feed tray main body 7 is opened and closed as a result of the paper feed tray main body 7 rotating about the rotation axis 12.

The paper feed tray extension member 8 is formed in a plate shape. A paper feed tray auxiliary placement surface 14 is formed on the paper feed tray extension member 8. The paper feed tray extension member 8 is supported by the paper feed tray main body 7 so as to be able to move with respect to the paper feed tray main body 7. The paper feed tray 3 extends and contracts as a result of the paper feed tray extension member 8 moving with respect to the paper feed tray main body 7.

The paper feed tray 3 is expanded or is stored in the medium conveying apparatus main body 2 as a result of the paper feed tray main body 7 being opened or closed or the paper feed tray 3 being extended or contracted. When the paper feed tray 3 is appropriately expanded, the paper feed tray main body 7 is arranged at the paper feed tray expansion position and is arranged at the rear side of the medium conveying apparatus main body 2 such that the paper feed tray placement surface 11 is oriented obliquely upward. When the paper feed tray main body 7 is arranged at the paper feed tray expansion position, the paper feed port 5 is connected to the paper feed tray main body 7 and is connected to the paper feed tray placement surface 11 of the paper feed tray main body 7.

When the paper feed tray 3 is appropriately expanded, the paper feed tray 3 is extended. When the paper feed tray 3 is appropriately extended, the paper feed tray extension member 8 is arranged at the paper feed tray extension position and is arranged at the exterior of the paper feed tray main body 7 such that the paper feed tray auxiliary placement surface 14 is substantially along the plane that is parallel to the paper feed tray placement surface 11.

Figure 2:
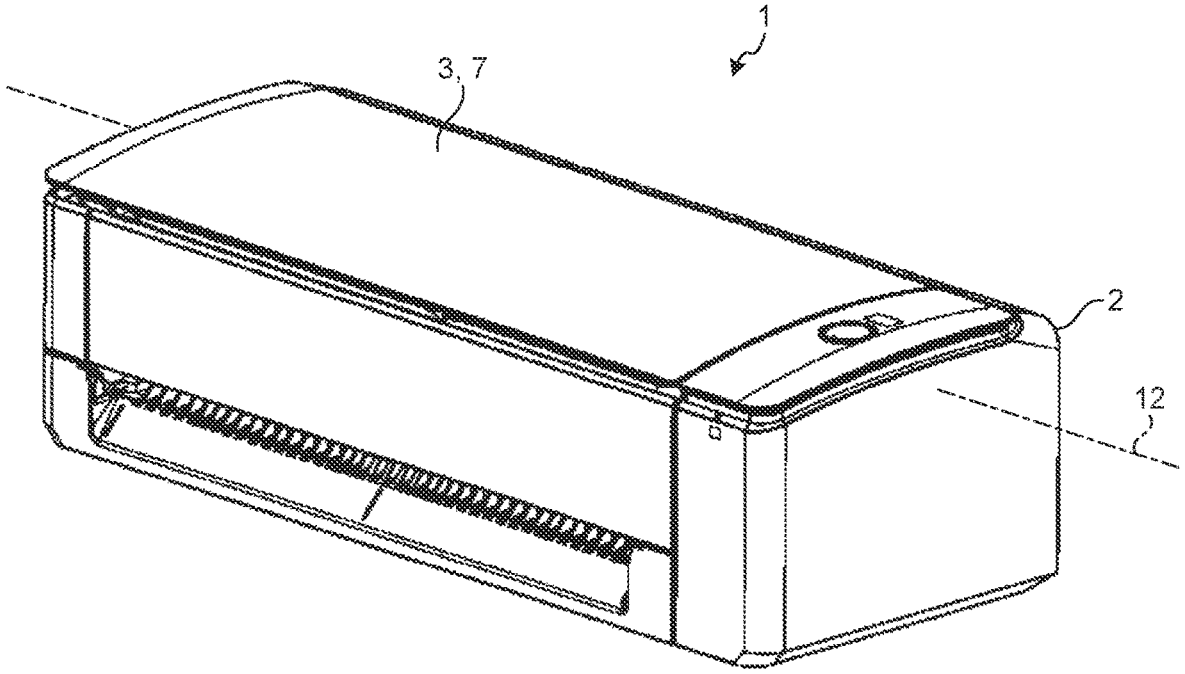
FIG. 2 is a perspective view illustrating the image reading apparatus when a paper feed tray is stored in a medium conveying apparatus main body.

FIG. 2 is a perspective view illustrating the image reading apparatus 1 when the paper feed tray 3 is stored in the medium conveying apparatus main body 2. The paper feed tray 3 is contracted when the paper feed tray 3 is appropriately stored in the medium conveying apparatus main body 2. When the paper feed tray 3 is appropriately contracted, the paper feed tray extension member 8 is arranged at the paper feed tray contraction position, is arranged at the storage space of the paper feed tray main body 7, and is stored. When the paper feed tray 3 is appropriately stored in the medium conveying apparatus main body 2, the paper feed tray main body 7 is arranged at the paper feed tray storage position and is arranged on the medium conveying apparatus main body 2 such that the paper feed tray placement surface 11 faces downward and is opposing to the paper feed tray main body 7. When the paper feed tray 3 is arranged at the paper feed tray storage position, the paper ejection port 6 is covered by the paper feed tray main body 7. When the paper feed tray main body 7 is arranged at the paper feed tray storage position, the image reading apparatus 1 is able to prevent a foreign object from entering the conveying path via the paper ejection port 6 as a result of the paper ejection port 6 being covered by the paper feed tray main body 7.

The paper feed tray 3 further includes a paper feed tray extension-and-contraction mechanism that is not illustrated. The paper feed tray extension-and-contraction mechanism mechanically causes the paper feed tray extension member 8 to move in conjunction with the opening and closing of the paper feed tray main body 7 and mechanically causes the paper feed tray 3 to be extended and contracted as a result of the opening and closing of the paper feed tray main body 7. In other words, when the paper feed tray main body 7 moves toward the paper feed tray expansion position, the paper feed tray extension-and-contraction mechanism causes the paper feed tray extension member 8 to move toward the paper feed tray extension position. When the paper feed tray main body 7 is arranged at the expansion position, the paper feed tray extension-and-contraction mechanism arranges the paper feed tray extension member 8 at the paper feed tray extension position. When the paper feed tray main body 7 moves toward the paper feed tray storage position, the paper feed tray extension-and-contraction mechanism causes the paper feed tray extension member 8 to move toward the paper feed tray contraction position. When the paper feed tray main body 7 is arranged at the paper feed tray storage position, the paper feed tray extension-and-contraction mechanism arranges the paper feed tray extension member 8 at the paper feed tray contraction position.

Figure 3:
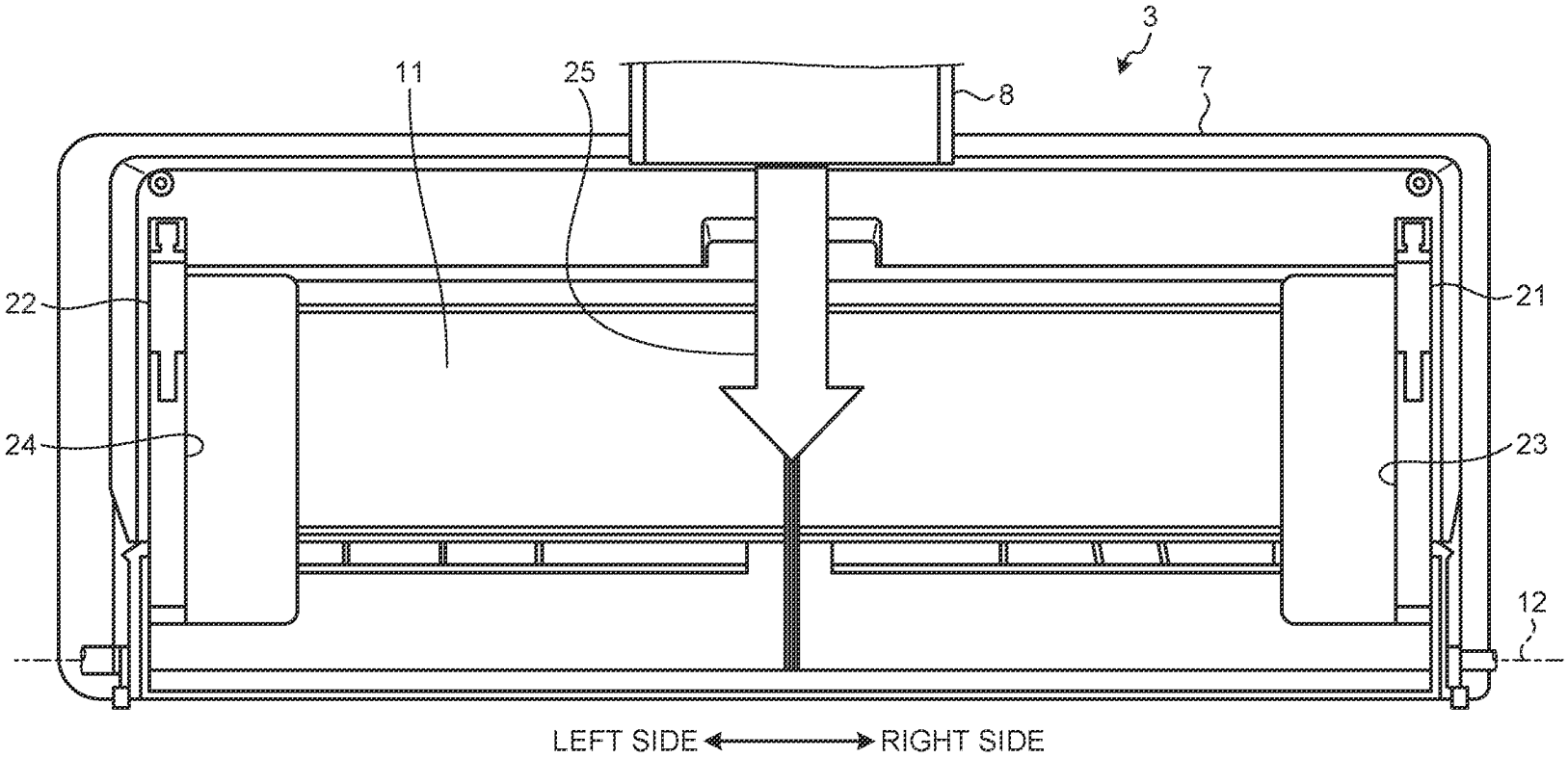
FIG. 3 is a plan view illustrating the paper feed tray, a right side guide, and a left side guide.

As illustrated in FIG. 3, the image reading apparatus 1 further includes a right side guide 21 and a left side guide 22. FIG. 3 is a plan view illustrating the paper feed tray 3, the right side guide 21, and the left side guide 22. A left-facing side guide surface 23 is formed on the right side guide 21. The right side guide 21 is arranged in a right side area of the paper feed tray placement surface 11 such that the left-facing side guide surface 23 faces the left side and such that the right side guide 21 protrudes from the paper feed tray placement surface 11. A right-facing side guide surface 24 is formed on the left side guide 22. The left side guide 22 is arranged in a left side area of the paper feed tray placement surface 11 such that the right-facing side guide surface 24 faces the right side and such that the left side guide 22 protrudes from the paper feed tray placement surface 11. The plane which the left-facing side guide surface 23 is along is perpendicular to the plane which the paper feed tray placement surface 11 is along, and is parallel to a conveying direction 25. The conveying direction 25 is parallel to the plane which the paper feed tray placement surface 11 is along, and is also perpendicular to the rotation axis 12. The plane that is parallel to the right-facing side guide surface 24 is perpendicular to the plane which the paper feed tray placement surface 11 is along, and is also parallel to the conveying direction 25. In other words, both of the right side guide 21 and the left side guide 22 are arranged such that the left-facing side guide surface 23 and the right-facing side guide surface 24 face each other.

Figure 4:
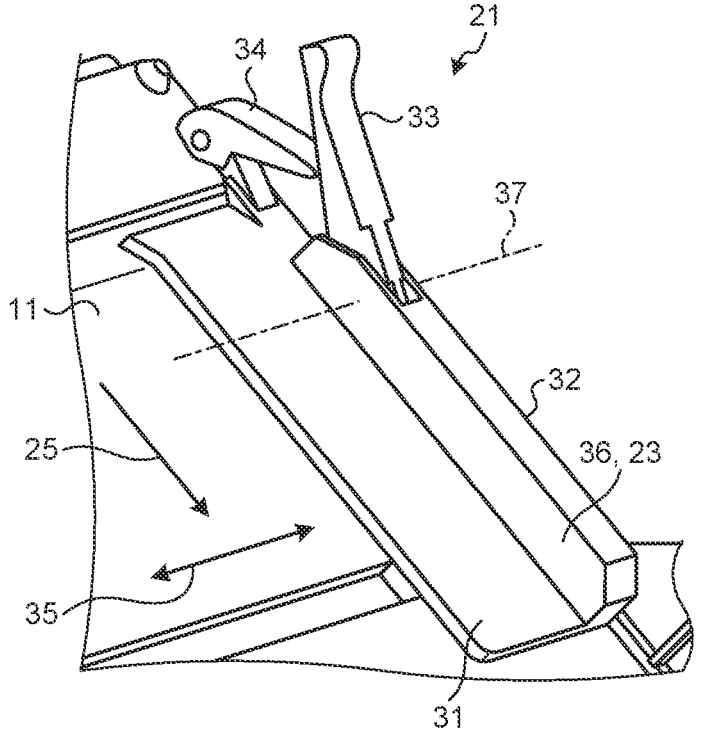
FIG. 4 is a perspective view illustrating the right side guide.

FIG. 4 is a perspective view illustrating the right side guide 21. The right side guide 21 includes a side guide base 31, a side guide main body 32, a movable member 33, and a lifting member 34. The side guide base 31 is formed in a substantially plate shape. The side guide base 31 is arranged so as to be along the paper feed tray placement surface 11 and is supported by the paper feed tray main body 7 so as to be able to translate in a width direction 35. The width direction 35 is parallel to the rotation axis 12, that is, the width direction 35 is parallel to the plane which the paper feed tray placement surface 11 is along, and is also perpendicular to the conveying direction 25.

A body side left-facing side guide surface 36 is formed on the side guide main body 32. The body side left-facing side guide surface 36 is a part of the left-facing side guide surface 23, that is, the plane that is parallel to the body side left-facing side guide surface 36 is perpendicular to the plane which the paper feed tray placement surface 11 is along, and is also parallel to the conveying direction 25. The side guide main body 32 is arranged such that the side guide main body 32 protrudes from the paper feed tray placement surface 11. The side guide main body 32 is integrally formed with the side guide base 31 and is fixed to the side guide base 31.

The movable member 33 is arranged on the upstream side of the side guide main body 32 in the conveying direction 25. The movable member 33 is supported by the side guide main body 32 so as to be rotatable about a rotation axis 37. The rotation axis 37 is parallel to the width direction 35, that is, the rotation axis 37 is parallel to the plane which the paper feed tray placement surface 11 is along, and is also perpendicular to the conveying direction 25. The movable member 33 is expanded or stored as a result of the movable member 33 rotating about the rotation axis 37. The movable member 33 is arranged at the movable member expansion position when the movable member 33 is expanded. The lifting member 34 is arranged between the movable member 33 and the paper feed tray main body 7 on the upstream side of the side guide main body 32 in the conveying direction 25, and is arranged below the movable member 33.

Figure 5:
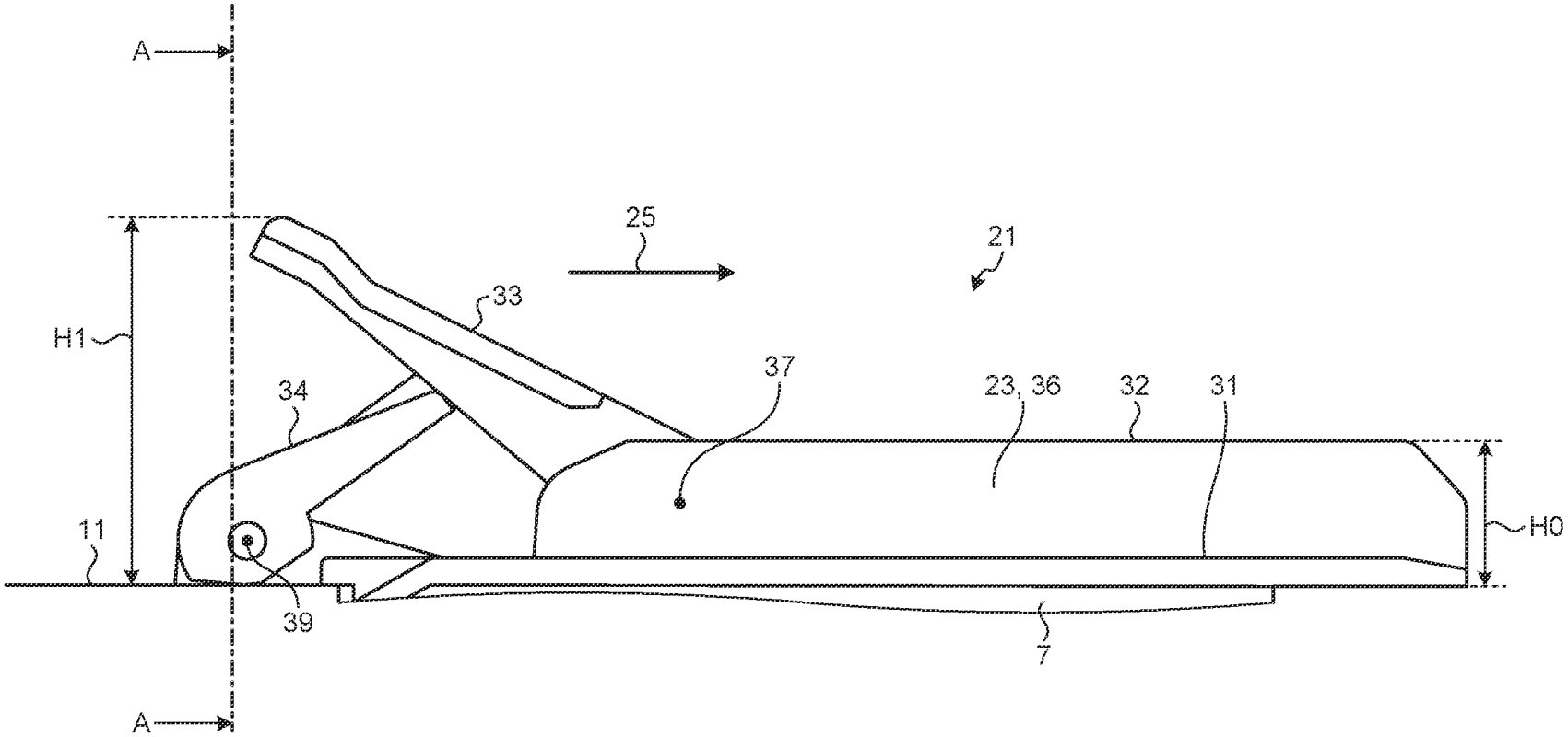
FIG. 5 is a side view illustrating the right side guide when a movable member is arranged at a movable member expansion position.

FIG. 5 is a side view illustrating the right side guide 21 when the movable member 33 is arranged at the movable member expansion position. When the movable member 33 is arranged at the movable member expansion position, the movable member 33 is regulated such that the movable member 33 does not rotate about the rotation axis 37 in a clockwise direction in FIG. 5. The height of the movable member 33 relative to the paper feed tray main body 7 indicates a distance between a point that is included in the movable member 33 and that is farthest from the paper feed tray placement surface 11 and the plane which the paper feed tray placement surface 11 is along. When the movable member 33 is arranged at the movable member expansion position, the height of the movable member 33 relative to the paper feed tray main body 7 is equal to a first height H1 and is higher than a height H0 of the side guide main body 32 relative to the paper feed tray main body 7.

The lifting member 34 is supported by the side guide base 31 so as to be rotatable about a rotation axis 39, that is, the lifting member 34 is supported by the side guide main body 32 via the side guide base 31 so as to be rotatable about the rotation axis 39. The rotation axis 39 is parallel to the rotation axis 37, that is, the rotation axis 39 is parallel to the plane, which the paper feed tray placement surface 11 is along, and is also perpendicular to the conveying direction 25. The lifting member 34 is expanded or stored as a result of the lifting member 34 rotating about the rotation axis 39. When the movable member 33 is arranged at the movable member expansion position, the lifting member 34 is expanded and is arranged at the lifting member expansion position.

Figure 6:
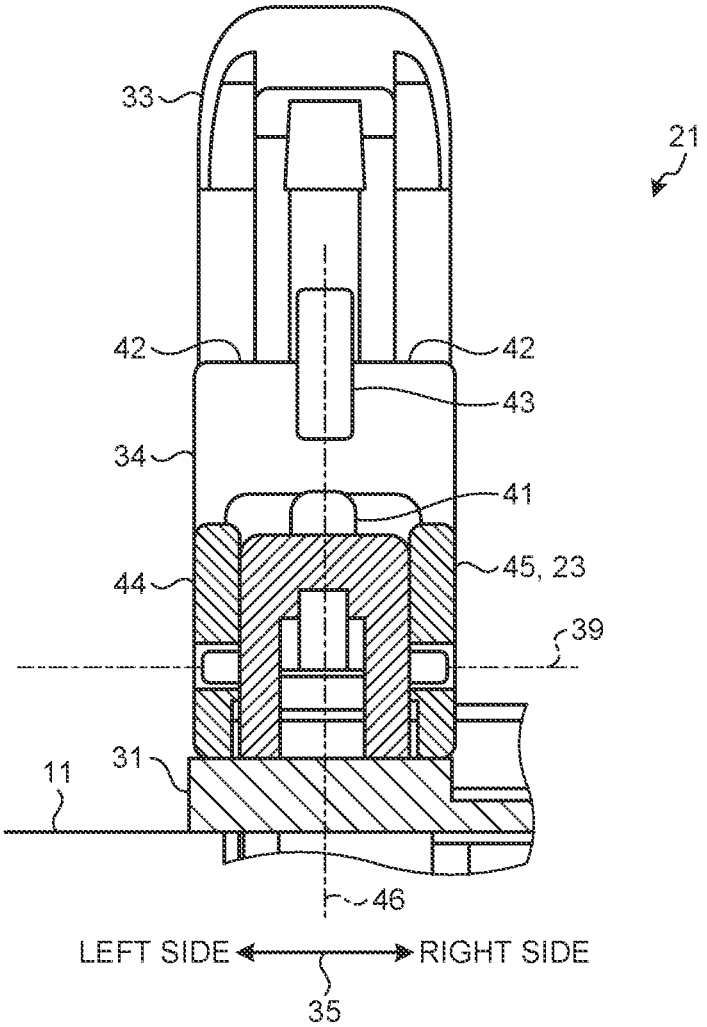
FIG. 6 is a cross-sectional view taken along a line A-A in FIG. 5 and illustrating the movable member, a lifting member, and a storage fixing projection.

As illustrated in FIG. 6, the right side guide 21 further includes a storage fixing projection 41. FIG. 6 is a cross-sectional view taken along a line A-A in FIG. 5 and illustrating the movable member 33, the lifting member 34, and the storage fixing projection 41. The storage fixing projection 41 is formed in a rod shape, and is arranged so as to protrude upward that is the direction in which the paper feed tray placement surface 11 faces. The storage fixing projection 41 is fixed to the side guide base 31, that is, the storage fixing projection 41 is fixed to the side guide main body 32 via the side guide base 31.

An abutting surface 42 and a projection 43 are further formed on the lifting member 34. The abutting surface 42 is formed on the upper side of the lifting member 34 opposing to the movable member 33. The projection 43 is formed so as to protrude to the upper side from the center area of the abutting surface 42 in the width direction 35, and is formed so as to protrude toward the movable member 33.

An upstream right-facing side guide surface 44 and an upstream left-facing side guide surface 45 are formed on the lifting member 34. The upstream right-facing side guide surface 44 is formed on a substantially flat shape. The upstream left-facing side guide surface 45 is formed on the opposite side of the side on which the upstream right-facing side guide surface 44 of the lifting member 34 is formed. The upstream left-facing side guide surface 45 is formed in a substantially flat manner so as to be along other plane parallel to the plane which the upstream right-facing side guide surface 44 is along.

The lifting member 34 is formed so as to be substantially symmetrical with respect to a symmetry plane 46. The symmetry plane 46 is perpendicular to the width direction 35 and is located at the center of the lifting member 34 in the width direction 35. For example, the distance between the symmetry plane 46 and the upstream right-facing side guide surface 44 is substantially equal to the distance between the symmetry plane 46 and the upstream left-facing side guide surface 45. The projection 43 is formed so as to intersect the symmetry plane 46.

Figure 7:
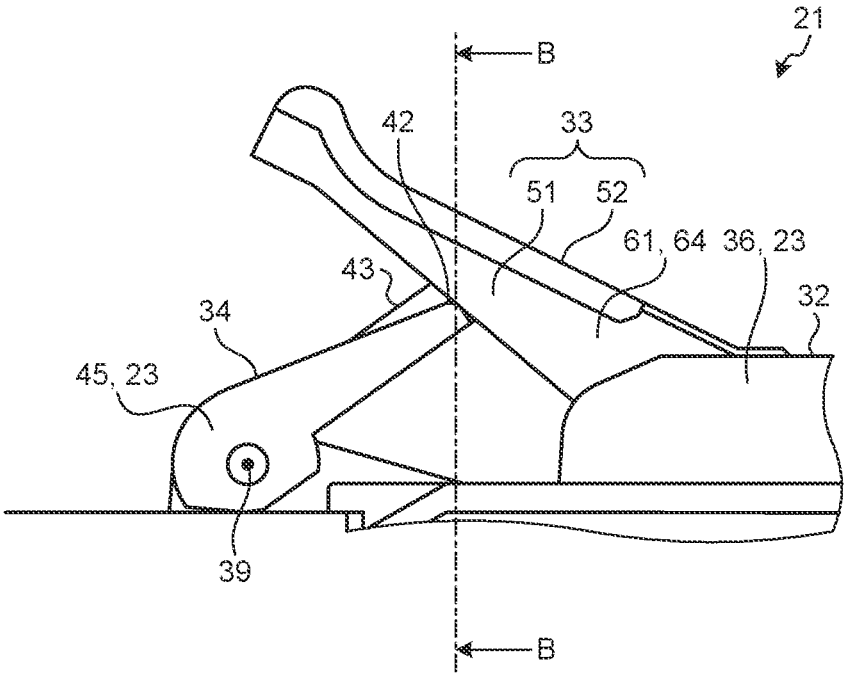
FIG. 7 is an enlarged side view illustrating the right side guide.

FIG. 7 is an enlarged side view illustrating the right side guide 21. The lifting member 34 is arranged such that the upstream left-facing side guide surface 45 is along the plane which the body side left-facing side guide surface 36 of the side guide main body 32 is along. In other words, the upstream left-facing side guide surface 45 is a part of the left-facing side guide surface 23, and both of the body side left-facing side guide surface 36 and the upstream left-facing side guide surface 45 are along the same plane.

Figure 8:
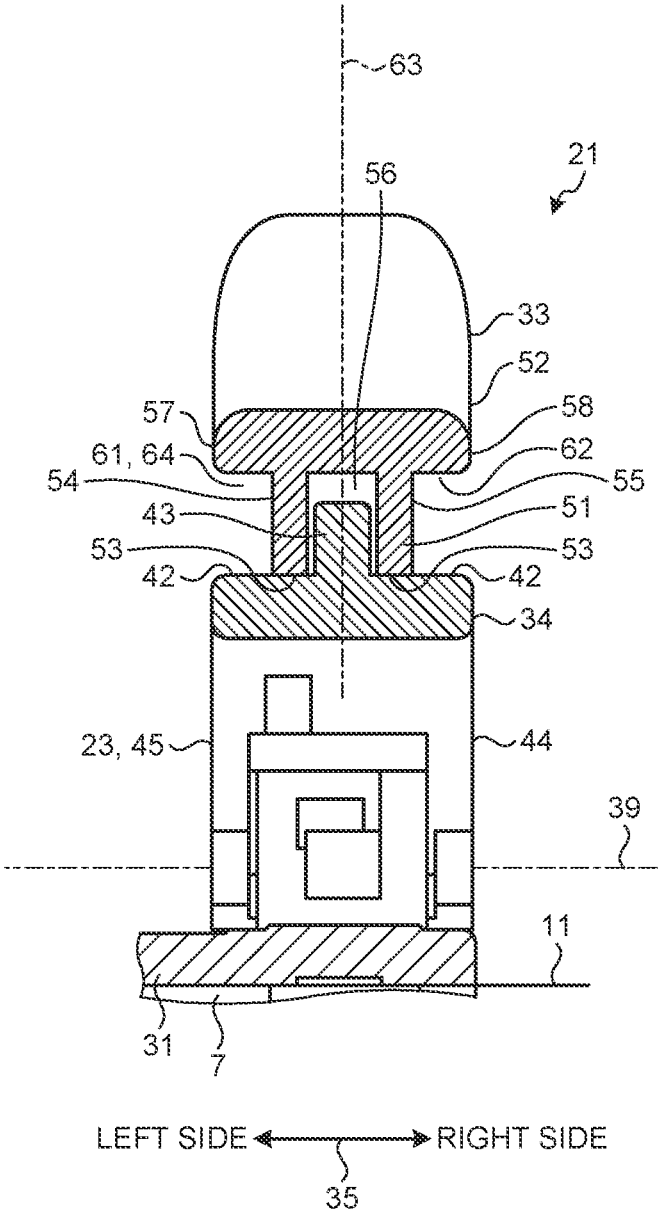
FIG. 8 is a cross-sectional view taken along a line B-B in FIG. 7 and illustrating the right side guide.

The movable member 33 includes a supporting portion 51 and a protrusion portion 52. FIG. 8 is a cross-sectional view illustrating the right side guide 21 taken along a line B-B in FIG. 7. A sliding surface 53, an inside notch left-facing side guide surface 54, an inside notch right-facing side guide surface 55, and a groove 56 are formed in the supporting portion 51. The sliding surface 53 is formed on the side opposing to the lifting member 34 of the supporting portion 51 and is formed in a substantially flat manner. The inside notch left-facing side guide surface 54 faces the left side, is formed at a position closer to the right side of the plane which the left-facing side guide surface 23 is along, and is along other plane parallel to the plane which the left-facing side guide surface 23 is along. The inside notch right-facing side guide surface 55 faces the right side, and is formed on the opposite side of the side on which the inside notch left-facing side guide surface 54 of the supporting portion 51 is formed. The groove 56 is formed at the center area of the sliding surface 53 in the width direction 35, that is, the groove 56 is formed on the side opposing to the lifting member 34 of the supporting portion 51.

The protrusion portion 52 is arranged on the supporting portion 51 so as to protrude from the inside notch left-facing side guide surface 54 and also protrude from the inside notch right-facing side guide surface 55. The protrusion portion 52 is integrally formed with the supporting portion 51 and is fixed to the supporting portion 51. A protrusion side left-facing side guide surface 57 and a protrusion side right-facing side guide surface 58 are formed on the protrusion portion 52. The protrusion side left-facing side guide surface 57 faces the left side and is along the plane which the upstream left-facing side guide surface 45 is along. In other words, the protrusion side left-facing side guide surface 57 is a part of the left-facing side guide surface 23, and the body side left-facing side guide surface 36, the upstream left-facing side guide surface 45, and the protrusion side left-facing side guide surface 57 are along the same plane. In other words, the protrusion portion 52 does not intersect the plane which the left-facing side guide surface 23 is along, that is, does not protrude to the left side from the plane which the left-facing side guide surface 23 is along. The protrusion side right-facing side guide surface 58 faces the right side, is formed on the opposite side of the side on which the protrusion side left-facing side guide surface 57 of the protrusion portion 52 is formed, and is along the plane which the upstream right-facing side guide surface 44 is along. In other words, the protrusion portion 52 does not intersect the plane which the upstream right-facing side guide surface 44 is along, that is, does not protrude to the right side from the plane which the upstream right-facing side guide surface 44 is along.

A left side notch 61 and a right side notch 62 are further formed on the movable member 33. The left side notch 61 is formed as a result of the protrusion portion 52 protruding from the inside notch left-facing side guide surface 54. The right side notch 62 is formed as a result of the protrusion portion 52 protruding from the inside notch right-facing side guide surface 55. The left side notch 61 is formed on the movable member 33, so that a depression 64 depressing from the left-facing side guide surface 23 is formed on the right side guide 21 when the movable member 33 is arranged at the movable member expansion position.

The movable member 33 is formed so as to be substantially symmetrical with respect to a symmetry plane 63. The symmetry plane 63 is perpendicular to the width direction 35 and is located at the center of the movable member 33 in the width direction 35. For example, the distance between the symmetry plane 63 and the protrusion side left-facing side guide surface 57 is substantially equal to the distance between the symmetry plane 63 and the protrusion side right-facing side guide surface 58. The groove 56 is formed so as to intersect the symmetry plane 63.

Figure 9:
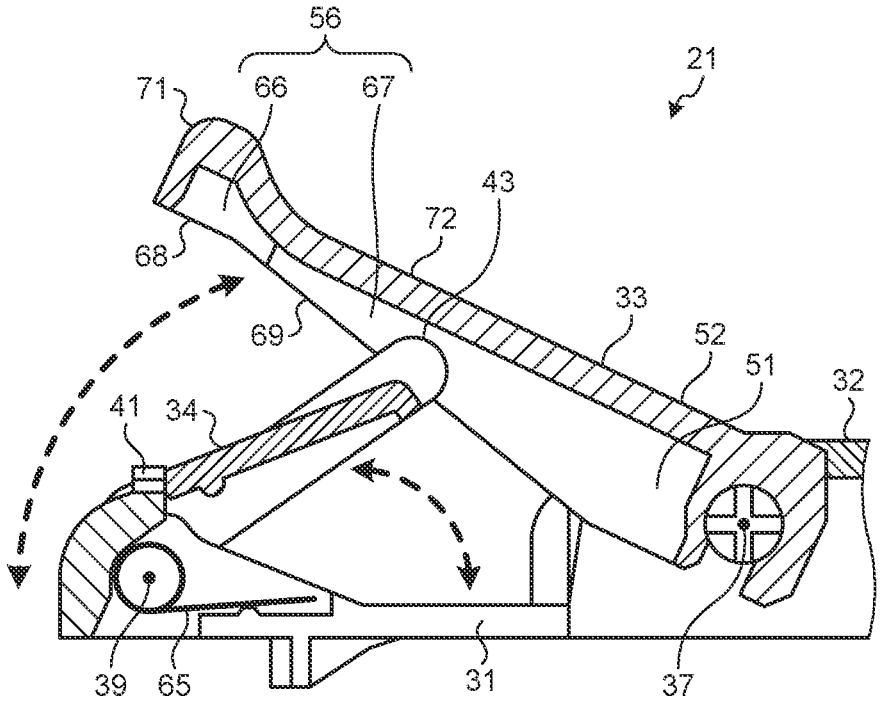
FIG. 9 is another cross-sectional view of the right side guide.

FIG. 9 is another cross-sectional view illustrating the right side guide 21. The right side guide 21 further includes a spring 65. The spring 65 is formed of a torsion coil spring. One end of the spring 65 is fixed to the lifting member 34, whereas the other end of the spring 65 is fixed to the side guide base 31. When the lifting member 34 is arranged at the lifting member expansion position, the spring 65 is elastically deformed and applies an elastic force to the lifting member 34 so as to counteract the movement of the lifting member 34 toward the lifting member storage position.

The groove 56 of the movable member 33 includes a first groove portion 66 and a second groove portion 67. The first groove portion 66 is formed at a position further away from the rotation axis 37 than the second groove portion 67. The depth of the second groove portion 67 is reduced toward the first groove portion 66. The depth of the first groove portion 66 is greater than the depth of the second groove portion 67 at the end that is closer to the first groove portion 66. The supporting portion 51 of the movable member 33 includes a first supporting portion 68 and a second supporting portion 69. The first groove portion 66 of the groove 56 is formed in the first supporting portion 68. The second groove portion 67 of the groove 56 is formed in the second supporting portion 69. In other words, the first supporting portion 68 is formed at a position further away from the rotation axis 37 than the second supporting portion 69.

The protrusion portion 52 includes a first protrusion portion 71 and a second protrusion portion 72. The first protrusion portion 71 protrudes from a portion that is formed at the first supporting portion 68 of the inside notch left-facing side guide surface 54, and protrudes from a portion that is formed at the first supporting portion 68 of the inside notch right-facing side guide surface 55. The first protrusion portion 71 is formed at a position further away from the rotation axis 37 than the second protrusion portion 72. The second protrusion portion 72 further protrudes from a portion that is formed at the second supporting portion 69 of the inside notch left-facing side guide surface 54, and protrudes from a portion that is formed at the second supporting portion 69 of the inside notch right-facing side guide surface 55.

The first protrusion portion 71 protrudes to the upper side than the second protrusion portion 72. As a result of the first protrusion portion 71 protruding to the upper side, even when the second supporting portion 69 is tapered toward the rotation axis 37, the first groove portion 66 is able to be formed such that the depth of the first groove portion 66 is greater than the depth of the second groove portion 67 at the end located on the side of the first groove portion 66. Furthermore, even when the depth of the first groove portion 66 is greater than the depth of the second groove portion 67 at the end located on the side of the first groove portion 66, the first protrusion portion 71 is able to be formed such that the thickness of the first protrusion portion 71 is not thinner than a predetermined thickness.

When the lifting member 34 is arranged at the lifting member expansion position and when the movable member 33 is arranged at the movable member expansion position, the projection 43 of the lifting member 34 comes into inside the second groove portion 67. As a result of the projection 43 coming into inside the second groove portion 67, the image reading apparatus 1 is able to reduce the degree of a movement of the movable member 33 in the width direction 35, and is able to appropriately support the movable member 33.

Figure 10:
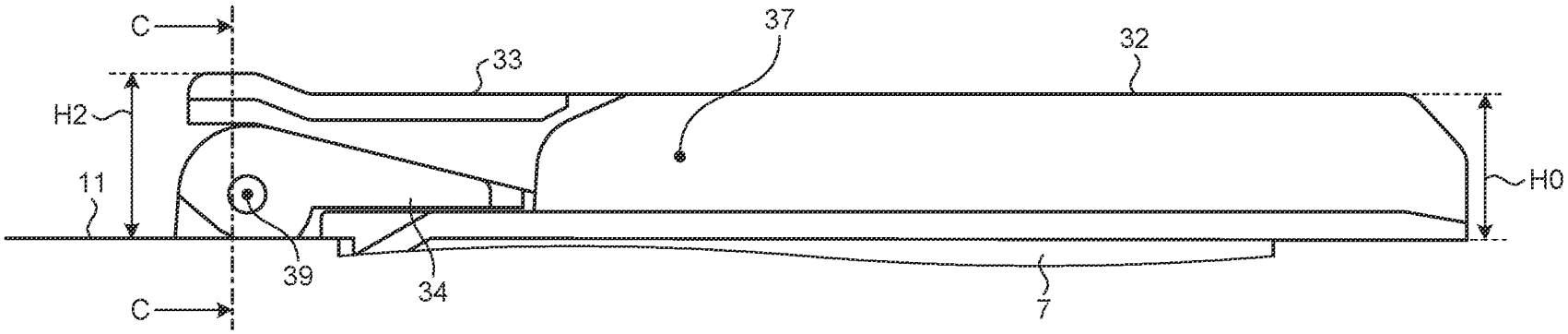
FIG. 10 is a side view illustrating the right side guide when the movable member is arranged at a movable member storage position.

As illustrated in FIG. 10, when the movable member 33 is appropriately stored, the movable member 33 is arranged at the movable member storage position. FIG. 10 is a side view illustrating the right side guide 21 when the movable member 33 is arranged at the movable member storage position. When the movable member 33 is arranged at the movable member storage position, the height of the movable member 33 relative to the paper feed tray main body 7 is equal to a second height H2 and is greater than the height H0 of the side guide main body 32 relative to the paper feed tray main body 7. Furthermore, the height of the second height H2 is lower than the first height H1.

When the movable member 33 is arranged at the movable member storage position, the lifting member 34 is stored and is arranged at the lifting member storage position. When the lifting member 34 is arranged at the lifting member storage position, the spring 65 is elastically deformed and applies an elastic force to the lifting member 34 such that the lifting member 34 moves toward the lifting member expansion position.

Figure 11:
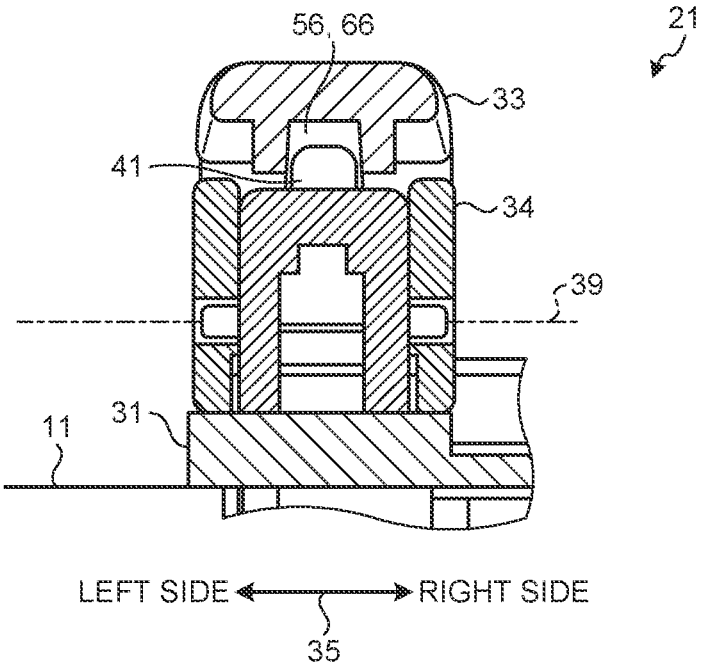
FIG. 11 is a cross-sectional view taken along a line C-C in FIG. 10 and illustrating the right side guide when the movable member is arranged at the movable member storage position.

FIG. 11 is a cross-sectional view taken along a line C-C in FIG. 10 and illustrating the right side guide 21 when the movable member 33 is arranged at the movable member storage position. When the movable member 33 is arranged at the movable member storage position, the storage fixing projection 41 is fitted in the first groove portion 66 of the groove 56 of the movable member 33. As a result of the storage fixing projection 41 being fitted into the first groove portion 66 of the groove 56, the image reading apparatus 1 is able to reduce the degree of a movement of the first protrusion portion 71 of the movable member 33 in the width direction 35 with respect to the side guide main body 32, and is able to appropriately support the movable member 33.

The left side guide 22 is formed so as to be the same as that the right side guide 21 is mirrored, and includes, similarly to the right side guide 21, a side guide base, a side guide main body, a movable member, a lifting member, a storage fixing projection, and a spring. At this time, as a result of the movable member 33 being formed symmetrically with respect to the symmetry plane 63, the movable member 33 is able to be used as a movable member of the left side guide 22. As a result of the lifting member 34 being formed symmetrically with respect to the symmetry plane 46, the lifting member 34 is able to be used as a lifting member of the left side guide 22. By using the movable member 33 and the lifting member 34 for both of the right side guide 21 and the left side guide 22, it is possible to reduce the manufacturing cost of the image reading apparatus 1.

Operation of Image Reading Apparatus 1

When a user stores the image reading apparatus 1, the user moves the paper feed tray main body 7 toward the paper feed tray storage position and arranges the paper feed tray main body 7 at the paper feed tray storage position. When the paper feed tray main body 7 is arranged at the paper feed tray storage position, the paper feed tray extension member 8 is stored in the storage space of the paper feed tray main body 7. As a result of the paper feed tray extension member 8 being arranged at the paper feed tray contraction position and the paper feed tray main body 7 being arranged at the paper feed tray storage position, the paper feed tray 3 is appropriately stored in the medium conveying apparatus main body 2.

When the paper feed tray main body 7 moves toward the paper feed tray storage position, the movable member 33 of the right side guide 21 moves toward the movable member storage position as a result of the first protrusion portion 71 of the movable member 33 coming into contact with the medium conveying apparatus main body 2. When the movable member 33 moves toward the movable member storage position, as a result of the abutting surface 42 of the lifting member 34 sliding the sliding surface 53 of the movable member 33, the lifting member 34 is pushed down by the movable member 33 and moves toward the lifting member storage position against the elastic force applied by the spring 65.

Figure 12:
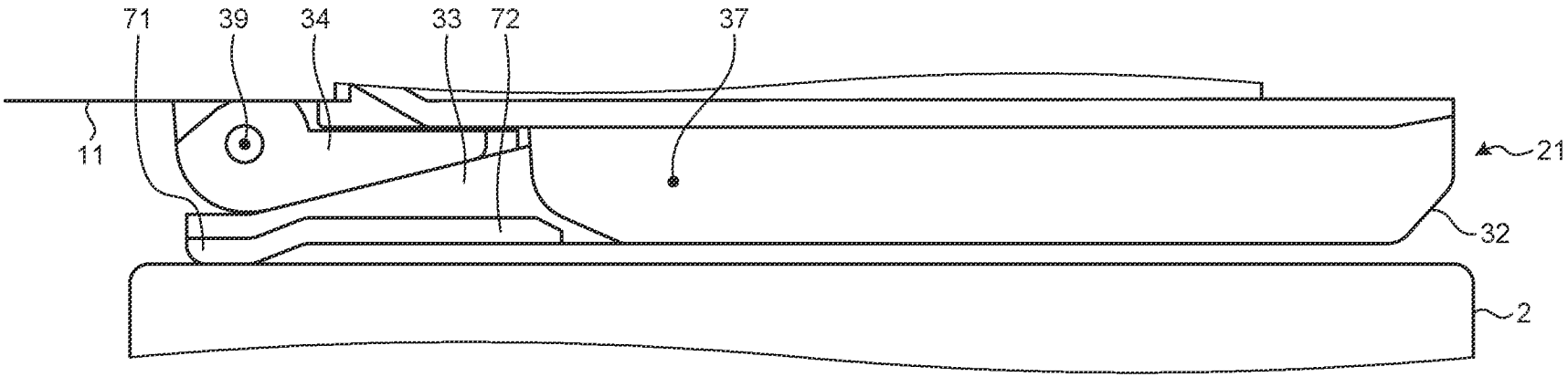
FIG. 12 is a side view illustrating the right side guide when the paper feed tray is stored in the medium conveying apparatus main body.

FIG. 12 is a side view illustrating the right side guide 21 when the paper feed tray 3 is stored in the medium conveying apparatus main body 2. When the paper feed tray main body 7 is arranged at the paper feed tray storage position, as a result of the first protrusion portion 71 of the movable member 33 coming into contact with the medium conveying apparatus main body 2, the movable member 33 is appropriately stored and arranged at the movable member storage position. As a result of the movable member 33 being arranged at the movable member storage position, the lifting member 34 is arranged at the lifting member storage position.

When the paper feed tray main body 7 is arranged at the paper feed tray storage position and when the movable member 33 is arranged at the movable member storage position, the storage fixing projection 41 is fitted into the first groove portion 66 of the groove 56 of the movable member 33. As a result of the storage fixing projection 41 being fitted into the first groove portion 66, when the movable member 33 is arranged at the movable member storage position, the image reading apparatus 1 is able to reduce the degree of movement of the movable member 33 in the width direction 35 and is able to appropriately support the movable member 33. Similarly to the movable member 33, when the paper feed tray main body 7 is arranged at the paper feed tray storage position, the movable member of the left side guide 22 is also appropriately stored.

As a result of the movable member 33 of the right side guide 21 and the movable member of the left side guide 22 being stored, the image reading apparatus 1 is able to reduce the space in the medium conveying apparatus main body 2 where the paper feed tray 3 is stored. As a result of the space in which the paper feed tray 3 is stored being reduced, it is possible to design the medium conveying apparatus main body 2 small in size, so that it is possible to reduce the size of the apparatus when the paper feed tray 3 is stored.

When the user attempts to read images of a plurality of media by using the image reading apparatus 1, the user moves the paper feed tray main body 7 toward the paper feed tray expansion position and arranges the paper feed tray main body 7 at the paper feed tray expansion position. When the paper feed tray main body 7 is arranged at the paper feed tray expansion position, the paper feed tray extension member 8 is arranged at the paper feed tray extension position due to the paper feed tray extension-and-contraction mechanism.

As a result of the paper feed tray 3 being expanded, the movable member 33 of the right side guide 21 is away from the medium conveying apparatus main body 2 and released. When the movable member 33 is released, the lifting member 34 moves toward the lifting member expansion position due to the elastic force applied by the spring 65. When the lifting member 34 moves toward the expansion position, as a result of the abutting surface 42 of the lifting member 34 sliding the sliding surface 53 of the movable member 33, the lifting member 34 lifts the movable member 33 and causes the movable member 33 to move toward the movable member expansion position. As a result of the lifting member 34 moving toward the lifting member expansion position, the movable member 33 is expanded and is arranged at the movable member expansion position. When the movable member 33 is arranged at the movable member expansion position, the spring 65 applies an elastic force to the lifting member 34 so as to counteract against a movement of the lifting member 34 toward the lifting member storage position, and then, holds the movable member 33 so as not to move toward the movable member storage position.

The projection 43 of the lifting member 34 is fitted in the groove 56 of the movable member 33, and when the lifting member 34 moves toward the lifting member expansion position, moves along the groove 56 of the movable member 33. When the movable member 33 moves toward the movable member expansion position, as a result of the projection 43 of the lifting member 34 being fitted in the groove 56 of the movable member 33, the image reading apparatus 1 is able to reduce the degree of the movement of the movable member 33 in the width direction 35. When the movable member 33 is arranged at the movable member expansion position, as a result of the projection 43 of the lifting member 34 being fitted in the groove 56 of the movable member 33, the image reading apparatus 1 is able to further reduce the degree of the movement of the movable member 33 in the width direction 35. Similarly to the movable member 33 of the right side guide 21, when the paper feed tray 3 is expanded, the movable member of the left side guide 22 is also expanded and is held in an expanded state.

Figure 13:
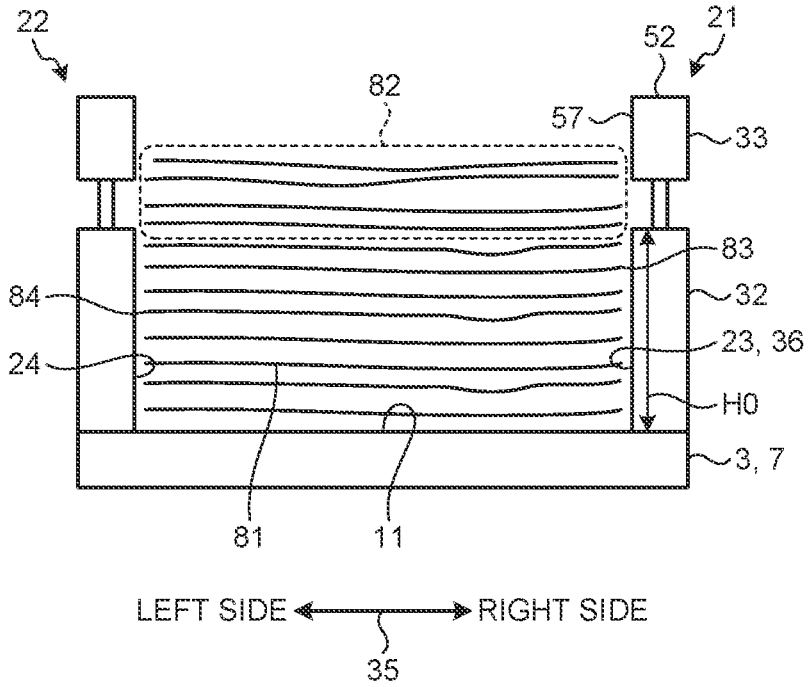
FIG. 13 is a cross-sectional view illustrating a plurality of media that are appropriately placed on the paper feed tray.

Furthermore, the user performs a translational movement of the right side guide 21 and the left side guide 22 in the width direction 35 such that the distance between the left-facing side guide surface 23 and the right-facing side guide surface 24 is substantially equal to the width of a plurality of media from which images are desired to be read in the width direction 35. Furthermore, as illustrated in FIG. 13, the user places the plurality of media on the paper feed tray 3 such that a plurality of media 81 from which images are desired to be read oppose to the paper feed tray placement surface 11. FIG. 13 is a cross-sectional view illustrating the plurality of media 81 that are appropriately placed on the paper feed tray 3. At this time, as a result of portions of the plurality of media 81 protruding from the paper feed tray main body 7 being placed on the paper feed tray extension member 8, the image reading apparatus 1 is able to prevent deviation or drop of the plurality of media 81 due to the weight of the protruding portions.

Furthermore, the user places the plurality of media on the paper feed tray 3 such that an end face 83 of each of the plurality of media 81 on the right side opposes to the left-facing side guide surface 23 and such that an end face 84 of each of the plurality of media 81 on the left side opposes to the right-facing side guide surface 24. For example, when the thickness of the plurality of media 81 is less than the height H0, the end face 83 of each of the plurality of media 81 on the right side opposes to the body side left-facing side guide surface 36. At this time, it is possible to appropriately place the plurality of media 81 on the paper feed tray 3 such that the end face 83 of each of the plurality of media 81 is aligned on the right side. The protrusion portion 52 of the movable member 33 of the right side guide 21 does not protrude toward the left side from the plane which the left-facing side guide surface 23 is along, so that the plurality of media 81 is placed on the paper feed tray 3 without the right ends of the plurality of media 81 being obstructed by the protrusion portion 52. In other words, the image reading apparatus 1 is able to simplify an operation, performed by the user, of placing the plurality of media 81 on the paper feed tray 3.

When the thickness of the plurality of media 81 is greater than the height H0, the end face of each of a plurality of media 82 on the right side arranged at a position that is higher than the height H0 opposes to the protrusion side left-facing side guide surface 57. At this time, in the image reading apparatus 1, as a result of both of the protrusion side left-facing side guide surface 57 and the body side left-facing side guide surface 36 being along the same plane, it is possible to appropriately place the plurality of media 81 on the paper feed tray 3 such that the end face 83 of each of the plurality of media 81 on the right side is aligned.

As a result of the end face 83 of each of the plurality of media 81 on the right side coming into contact with the left-facing side guide surface 23, the right side guide 21 is able to appropriately place the plurality of media 81 on the paper feed tray 3 without the plurality of media 81 being inclined with respect to the conveying direction 25. At this time, the right side guide 21 is able to further prevent an inclination of the plurality of media 81 with respect to the conveying direction 25 as the length of the left-facing side guide surface 23 in the conveying direction 25 increases. As a result of both of the body side left-facing side guide surface 36 and the upstream left-facing side guide surface 45 being included in the left-facing side guide surface 23, the right side guide 21 is able to increase the length of the left-facing side guide surface 23 in the conveying direction 25. As a result, the right side guide 21 is able to further prevent an inclination of the plurality of media 81 with respect to the conveying direction 25 as compared to other right side guide in which the upstream left-facing side guide surface 45 is not formed on the lifting member 34. The left side guide 22 is formed by using the same method as that used for the right side guide 21, so that, similarly to the right side guide 21, the left side guide 22 is also able to prevent an inclination of the plurality of media 81 with respect to the conveying direction 25.

When the plurality of media 81 is placed on the paper feed tray 3, as a result of the paper feed tray placement surface 11 being oriented obliquely upward, the plurality of media 81 moves toward the paper feed port 5 in the conveying direction 25 due to gravity and is inserted in the paper feed port 5. At this time, as a result of the end face 83 and the end face 84 of each of the plurality of media 81 opposing to the left-facing side guide surface 23 and the right-facing side guide surface 24, respectively, the image reading apparatus 1 is able to prevent a movement of the plurality of media 81 in the width direction 35.

The plurality of media that are inserted in the paper feed port 5 are supplied to the conveying path one by one by the conveying unit. The medium supplied to the conveying path are conveyed along the conveying path. Images on the medium conveyed along the conveying path are captured by the reading unit. The medium having captured image are ejected from the paper ejection port 6 by the conveying unit. The image reading apparatus 1 repeatedly performs an operation of conveying the medium and an operation of capturing the image of the medium until all of the plurality of media inserted in the paper feed port 5 are ejected from the paper ejection port 6.

Figure 14:
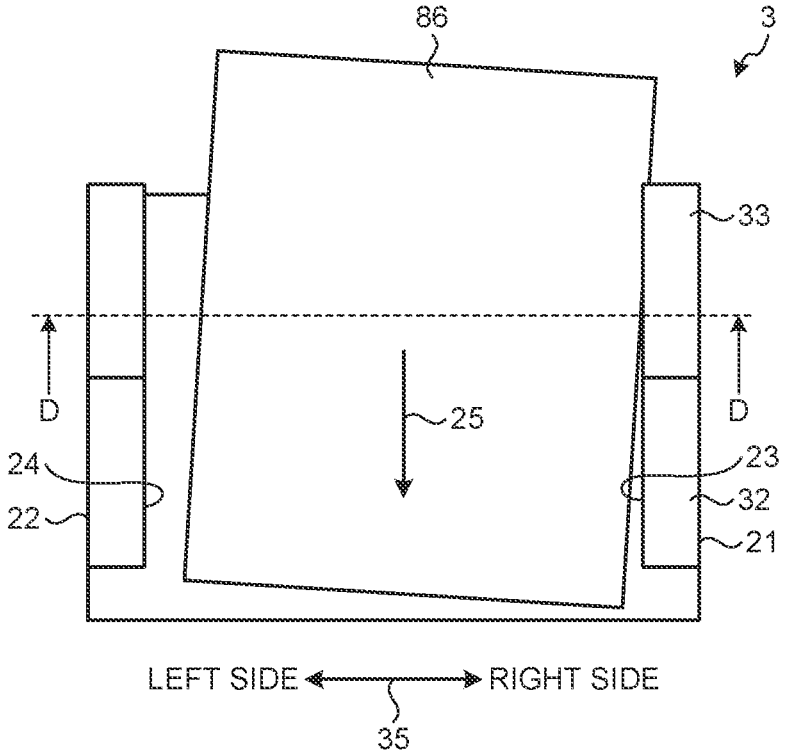
FIG. 14 is a plan view illustrating a medium placed on the paper feed tray with inclined manner with respect to a conveying direction.

As illustrated in FIG. 14, even when both of the right side guide 21 and the left side guide 22 are provided in the image reading apparatus 1, a medium 86 placed on the paper feed tray 3 is sometimes inclined with respect to the conveying direction 25. FIG. 14 is a plan view illustrating the medium 86 placed on the paper feed tray 3 inclined with respect to the conveying direction 25.

Figure 15:
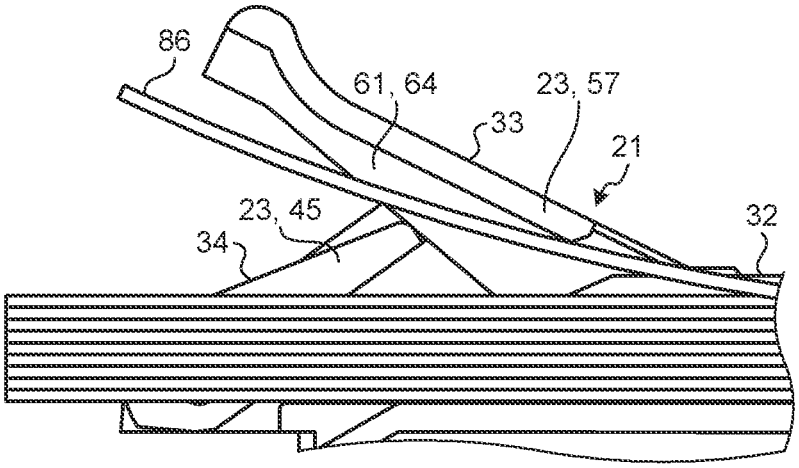
FIG. 15 is a cross-sectional view illustrating a medium inclined with respect to the conveying direction.

As illustrated in FIG. 15, when the medium 86 moves in the conveying direction 25, the end portion of the medium 86 opposing to the left-facing side guide surface 23 sometimes rises along the left-facing side guide surface 23 and climbs up. FIG. 15 is a cross-sectional view illustrating the medium 86 inclined with respect to the conveying direction 25.

Figure 16:
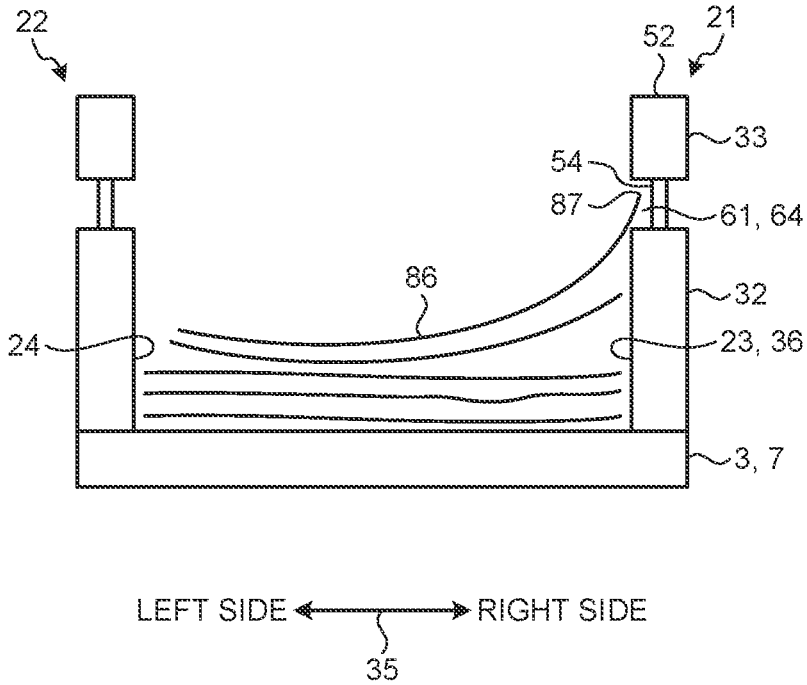
FIG. 16 is a cross-sectional view taken along a line D-D in FIG. 14 and illustrating the right side guide and the medium inclined with respect to the conveying direction.

As illustrated in FIG. 16, as a result of an end portion 87 climbing up, the end portion 87 opposing to the left-facing side guide surface 23 of the medium 86 comes into the depression 64 of the left-facing side guide surface 23. FIG. 16 indicates a cross-sectional view taken along a line D-D in FIG. 14 and illustrates the medium 86 inclined with respect to the conveying direction 25 and the right side guide 21. When the end portion 87 of the medium 86 on the right side comes into the depression 64, the end portion 87 rises along the inside notch left-facing side guide surface 54 and is caught by the protrusion portion 52 of the movable member 33. As a result of the end portion 87 being caught by the protrusion portion 52, the right side guide 21 is able to prevent a movement of the end portion 87 of the medium 86 to the upper side of the protrusion portion 52, and is able to prevent the medium 86 from climbing over the right side guide 21.

Because the medium 86 is prevented from climbing over the right side guide 21, when the medium 86 moves in the conveying direction 25, the image reading apparatus 1 is able to prevent the medium 86 from being further inclined with respect to the conveying direction 25. Because the inclination of the medium 86 is prevented, the image reading apparatus 1 is able to prevent skew of the medium 86 that is supplied to the conveying path in an inclined state, and is able to prevent an occurrence of jam caused by the medium 86 being jammed on the conveying path due to skew of the medium 86.

Effects of Medium Conveying Apparatus According to the Embodiment

The medium conveying apparatus according to the embodiment includes the paper feed tray main body 7 that is rotatably supported by the medium conveying apparatus main body 2 so as to be stored and expanded, and the right side guide 21 in which the left-facing side guide surface 23 opposing to the end face of the medium placed on the paper feed tray main body 7 is formed. The right side guide 21 includes the side guide main body 32 that is supported by the paper feed tray main body 7, and the movable member 33 that is supported by the side guide main body 32 so as to be stored and expanded. The height of the movable member 33 relative to the paper feed tray main body 7 is equal to the first height H1 that is higher than the height H0 of the side guide main body 32 relative to the paper feed tray main body 7 when the movable member 33 is expanded, and is equal to the second height H2 that is lower than the first height H1 when the movable member 33 is stored. In the movable member 33, the left side notch 61 is formed such that the depression 64 is formed on the left-facing side guide surface 23 when the movable member 33 is expanded.

When the medium is inclined, the end portion of the medium comes into the depression 64, so that the medium conveying apparatus according to the embodiment is able to prevent the end portion of the medium from climbing over the right side guide 21. Furthermore, the medium conveying apparatus according to the embodiment is able to store the movable member 33 such that the height of the movable member 33 relative to the paper feed tray main body 7 is lower, and thus, is able to reduce the space in which the right side guide 21 is stored. As a result, the medium conveying apparatus according to the embodiment is able to prevent a problem that the medium climbs over the right side guide 21, and is also able to reduce the space in which the tray is stored.

Furthermore, the movable member 33 included in the medium conveying apparatus according to the embodiment includes the supporting portion 51 that is rotatably supported by the side guide main body 32, and the protrusion portion 52 that is fixed to the supporting portion 51. The inside notch left-facing side guide surface 54 opposing to the end face of the medium placed on the paper feed tray main body 7 is formed on the supporting portion 51. The left side notch 61 is formed as a result of the protrusion portion 52 protruding from the inside notch left-facing side guide surface 54. At this time, the medium conveying apparatus according to the embodiment is able to appropriately prevent the end portion of the medium from climbing over the right side guide 21 as a result of the end portion that comes into the left side notch 61 of the medium being caught by the protrusion portion 52.

Furthermore, the protrusion portion 52 included in the medium conveying apparatus according to the embodiment is formed so as not to intersect the plane which the left-facing side guide surface 23 is along. At this time, the protrusion portion 52 does not interfere when the medium is placed on the paper feed tray main body 7, so that the medium conveying apparatus according to the embodiment is able to simplify an operation, performed by the user, of placing the medium on the paper feed tray main body 7.

Incidentally, the protrusion portion 52 included in the medium conveying apparatus according to the embodiment as described above is formed so as not to protrude from the plane which the left-facing side guide surface 23 is along; however, the protrusion portion 52 may protrude from the plane which the left-facing side guide surface 23 is along such that the protrusion portion 52 intersects the plane which the left-facing side guide surface 23 is along. Even when the protrusion portion 52 intersects the plane which the left-facing side guide surface 23 is along, similarly to the medium conveying apparatus according to the embodiment as described above, the medium conveying apparatus is able to prevent the problem that the medium climbs over the right side guide 21, and is also able to reduce the space in which the paper feed tray 3 is stored. Furthermore, the protrusion portion 52 of the medium conveying apparatus according to the embodiment described above protrudes such that the protrusion side left-facing side guide surface 57 forms a part of the left-facing side guide surface 23; however, the protrusion portion 52 may protrude to a lower position so as not to intersect the plane which the left-facing side guide surface 23 is along. Even when the protrusion portion 52 protrudes to a lower position, the end portion of the inclined medium is caught by the protrusion portion 52, so that the medium conveying apparatus is able to prevent the problem that the medium climbs over the right side guide 21, and is also able to reduce the space in which the paper feed tray 3 is stored.

Furthermore, the medium conveying apparatus according to the embodiment further includes the lifting member 34 that is rotatably supported by the side guide main body 32, and the spring 65 that applies an elastic force to the lifting member 34 such that the lifting member 34 is expanded. When the paper feed tray main body 7 is stored, the paper feed tray placement surface 11 of the paper feed tray main body 7 opposing to the medium opposes to the medium conveying apparatus main body 2. When the lifting member 34 is expanded, the movable member 33 is expanded as a result of the lifting member 34 lifting the supporting portion 51, and when the paper feed tray main body 7 is stored, the movable member 33 is stored as a result of the protrusion portion 52 coming into contact with the medium conveying apparatus main body 2. When the movable member 33 is stored, the lifting member 34 is stored against the elastic force applied by the spring 65 as a result of the supporting portion 51 pushing down the lifting member 34. The medium conveying apparatus according to the embodiment is able to automatically open and close the movable member 33 in conjunction with opening and closing of the paper feed tray main body 7, eliminate an operation, performed by the user, of expanded and storing the movable member 33, and thus, simplify an operation performed by the user.

Incidentally, in the medium conveying apparatus according to the embodiment as described above, the lifting member 34 and the spring 65 are provided; however, the lifting member 34 and the spring 65 may be omitted. Even when the lifting member 34 and the spring 65 are omitted, similarly to the medium conveying apparatus according to the embodiment as described above, the medium conveying apparatus is able to prevent the problem that the medium climbs over the right side guide 21, and is also able to reduce the space in which the paper feed tray 3 is stored.

Furthermore, in the lifting member 34 included in the medium conveying apparatus according to the embodiment, the upstream left-facing side guide surface 45 along the plane which the left-facing side guide surface 23 is along is formed. As a result of the upstream left-facing side guide surface 45 being provided, the medium conveying apparatus according to the embodiment is able to increase the length of the left-facing side guide surface 23 in the conveying direction 25 without increasing the length of the side guide main body 32 in the conveying direction 25. As a result of the length of the left-facing side guide surface 23 in the conveying direction 25 being increased, the medium conveying apparatus according to the embodiment is appropriately prevent skew of the medium occurring when the medium moves to the conveying direction 25.

Incidentally, in the medium conveying apparatus according to the embodiment as described above, the upstream right-facing side guide surface 44 is formed on the lifting member 34; however, the upstream right-facing side guide surface 44 may be omitted. Even when the upstream right-facing side guide surface 44 is omitted, similarly to the medium conveying apparatus according to the embodiment as described above, the medium conveying apparatus is able to prevent the problem that the medium climbs over the right side guide 21, and is also able to reduce the space in which the paper feed tray 3 is stored.

Furthermore, the groove 56 is formed in the supporting portion 51 included in the medium conveying apparatus according to the embodiment. In the lifting member 34, the projection 43 that is fitted in the groove 56 is formed. When the lifting member 34 moves, the projection 43 moves along the groove 56. When the movable member 33 moves, the medium conveying apparatus according to the embodiment is able to reduce the degree of a movement of the movable member 33 in the width direction 35.

Incidentally, in the medium conveying apparatus according to the embodiment as described above, the groove 56 and the projection 43 are provided; however, the groove 56 and the projection 43 may be omitted. Even when the groove 56 and the projection 43 are omitted, similarly to the medium conveying apparatus according to the embodiment as described above, the medium conveying apparatus is able to prevent the problem that the medium climbs over the right side guide 21, and is also able to reduce the space in which the paper feed tray 3 is stored.

Furthermore, the medium conveying apparatus according to the embodiment further includes the storage fixing projection 41. The storage fixing projection 41 is fixed to the side guide main body 32 and when the movable member 33 is stored, the storage fixing projection 41 is fit into the groove 56. When the movable member 33 is stored, the medium conveying apparatus according to the embodiment is able to reduce the degree of a movement of the movable member 33 in the width direction 35, and is able to appropriately support the movable member 33.

Incidentally, in the medium conveying apparatus according to the embodiment as described above, the storage fixing projection 41 is provided; however, the storage fixing projection 41 may be omitted. Even when the storage fixing projection 41 is omitted, similarly to the medium conveying apparatus according to the embodiment as described above, the medium conveying apparatus is able to prevent the problem that the medium climbs over the right side guide 21, and is also able to reduce the space in which the paper feed tray 3 is stored.

Furthermore, the supporting portion 51 included in the medium conveying apparatus according to the embodiment includes the first supporting portion 68 in which the first groove portion 66 that is fit into the storage fixing projection 41 of the groove 56 is formed, and the second supporting portion 69 in which the second groove portion 67 that is fit in the projection 43 of the groove 56 is formed. The protrusion portion 52 includes the first protrusion portion 71 that protrudes from the first supporting portion 68 of the inside notch left-facing side guide surface 54, and the second protrusion portion 72 that protrudes from the second supporting portion 69 from the inside notch left-facing side guide surface 54. The first protrusion portion 71 is arranged on the upper side of the plane which the second protrusion portion 72 is along.

At this time, in the medium conveying apparatus according to the embodiment, even when the supporting portion 51 is tapered such that the first supporting portion 68 is smaller than the second supporting portion 69, the first groove portion 66 is able to be formed such that the depth of the first groove portion 66 is greater than a predetermined depth. Furthermore, even when the depth of the first groove portion 66 is greater than the predetermined depth, the first protrusion portion 71 is able to be formed such that the thickness of the first protrusion portion 71 is greater than the predetermined depth. As a result, when the movable member 33 is stored, the medium conveying apparatus according to the embodiment is able to appropriately support the movable member 33 so as to reduce the degree of the movement of the movable member 33 in the width direction 35, or, is able to improve the strength of the movable member 33.

Incidentally, in the medium conveying apparatus according to the embodiment as described above, the first protrusion portion 71 is arranged on the upper side of the second protrusion portion 72; however, the first protrusion portion 71 and the second protrusion portion 72 may be formed to be along a single plane. In this case, also, similarly to the medium conveying apparatus according to the embodiment as described above, the medium conveying apparatus is able to prevent the problem that the medium climbs over the right side guide 21, and is also able to reduce the space in which the paper feed tray 3 is stored.

Furthermore, in the supporting portion 51 included in the medium conveying apparatus according to the embodiment, the inside notch right-facing side guide surface 55 is formed on the opposite side of the side on which the inside notch left-facing side guide surface 54 is formed. The protrusion portion 52 further protrudes from the inside notch right-facing side guide surface 55. At this time, the movable member 33 is able to be formed symmetrically with respect to the symmetry plane 63. When the movable member 33 of the right side guide 21 is formed symmetrically with respect to the symmetry plane 63, the movable member 33 of the right side guide 21 is able to be used as a movable member of the left side guide 22. When the movable member 33 of the right side guide 21 is used as the movable member of the left side guide 22, the medium conveying apparatus according to the embodiment need not separately manufacture the movable member of the left side guide 22 and the movable member 33 of the right side guide 21. As a result, by manufacturing the movable member of the left side guide 22 and the movable member 33 of the right side guide 21 as the same parts, the medium conveying apparatus according to the embodiment is able to reduce the manufacturing cost.

Incidentally, in the medium conveying apparatus according to the embodiment as described above, the shape of the movable member of the left side guide 22 and the shape of the movable member 33 of the right side guide 21 are the same; however, the shape of the movable member of the left side guide 22 may be different from the shape of the movable member 33 of the right side guide 21. In this case, also, similarly to the medium conveying apparatus according to the embodiment as described above, the medium conveying apparatus is able to prevent the problem that the medium climbs over the right side guide 21, and is also able to reduce the space in which the paper feed tray 3 is stored.

Incidentally, the medium conveying apparatus according to the embodiment as described above includes the paper feed tray extension-and-contraction mechanism; however, the paper feed tray extension-and-contraction mechanism may be omitted. At this time, the paper feed tray extension member 8 is arranged at the paper feed tray contraction position or arranged at the paper feed tray extension position by a manual operation performed by the user. The paper feed tray extension member 8 may further manually arranged at other position that is different from the paper feed tray contraction position and the paper feed tray extension position such that the paper feed tray 3 is adjusted its extension level in stages. Furthermore, the medium conveying apparatus according to the embodiment as described above includes the paper feed tray extension member 8; however, the paper feed tray extension member 8 may be omitted. In this case, also, similarly to the medium conveying apparatus according to the embodiment as described above, the medium conveying apparatus is able to prevent the problem that the medium climbs over the right side guide 21, and is also able to reduce the space in which the paper feed tray 3 is stored.

Incidentally, the medium conveying apparatus according to the embodiment as described above is used in the image reading apparatus 1; however the medium conveying apparatus may be used for other device. An example of the other device includes a printer that prints characters or diagrams on a medium. In the printer, the reading unit included in the medium conveying apparatus according to the embodiment as described above is replaced with a printing unit that prints characters or diagrams on a medium that is conveyed along the conveying path. In this case, also, similarly to the medium conveying apparatus according to the embodiment as described above, the medium conveying apparatus is able to prevent the problem that the medium climbs over the right side guide 21, and is also able to reduce the space in which the paper feed tray 3 is stored.

The medium conveying apparatus of the present disclosure is able to prevent the problem that the medium climbs over the right side guide, and is also able to reduce the space in which the tray is stored.

All examples and conditional language recited herein are intended for pedagogical purposes of aiding the reader in understanding the disclosure and the concepts contributed by the inventor to further the art, and are not to be construed as limitations to such specifically recited examples and conditions, nor does the organization of such examples in the specification relate to a showing of the superiority and inferiority of the disclosure. Although the embodiments of the disclosure have been described in detail, it should be understood that the various changes, substitutions, and alterations could be made hereto without departing from the spirit and scope of the disclosure.

What is claimed is:

1. A medium conveying apparatus comprising:
- a main body;
- a tray that is rotatably supported by the main body; and
- a side guide on which a side guide surface opposing to an end face of a medium placed on the tray is formed, wherein
- the side guide includes
  - a side guide main body that is supported by the tray, and
  - a movable member that is rotatably supported by the side guide main body so as to be stored and expanded,
- a notch is formed on the movable member such that a depression is formed on the side guide surface when the movable member is expanded,
- a height of an end portion on an upstream side of the movable member relative to the tray is higher than a height of an end portion on a downstream side of the side guide main body relative to the tray when the movable member is extended,
- the movable member includes
  - a supporting portion that is rotatably supported by the side guide main body, and
  - a protrusion portion that is fixed to the supporting portion,
- an inside notch side guide surface opposing to the end face formed on the supporting portion, and
- the notch is formed as a result of the protrusion portion protruding from the inside notch side guide surface.

2. The medium conveying apparatus according to claim 1, wherein the protrusion portion is formed so as not to intersect a plane which the side guide surface is along.

3. The medium conveying apparatus according to claim 1, further comprising:
- a lifting member that is rotatably supported by the side guide main body; and
- an elastic member that applies an elastic force to the lifting member such that the lifting member is expanded, wherein
- a placement surface of the tray opposing to the medium opposes to the main body when the tray is stored,
- the movable member is
  - expanded, when the lifting member is expanded, as a result of the lifting member lifting the supporting portion, and is
  - stored, when the tray is stored, as a result of the protrusion portion coming into contact with the main body, and
- the lifting member is stored against the elastic force, when the movable member is stored, as a result of the supporting portion pushing down the lifting member.

4. The medium conveying apparatus according to claim 3, wherein another side guide surface that is along a plane which the side guide surface is along is formed on the lifting member.

5. The medium conveying apparatus according to claim 3, wherein a groove is formed in the supporting portion, a projection fitted in the groove is formed on the lifting member, and the projection moves along the groove when the lifting moves.

6. The medium conveying apparatus according to claim 5, further comprising a storage fixing projection that is fixed to the side guide main body and that is fitted into the groove when the movable member is stored.

7. The medium conveying apparatus according to claim 6, wherein the supporting portion includes a first supporting portion in which a portion of the groove fitting to the storage fixing projection is formed, and a second supporting portion in which another portion of the groove different from the portion is formed, the protrusion portion includes a first protrusion portion that protrudes from a portion of the inside notch side guide surface formed on the first supporting portion, and a second protrusion portion that protrudes a portion of the inside notch side guide surface formed in the second supporting portion, and the first protrusion portion is arranged at a position further away from the storage fixing projection than a plane which the second protrusion portion is along.

8. The medium conveying apparatus according to claim 1, an opposite side inside notch side guide surface is formed in the supporting portion at an opposite side of a side on which the inside notch side guide surface is formed, and the protrusion portion further protrudes from the opposite side inside notch side guide surface.

9. A medium conveying apparatus comprising:

a tray that is rotatably supported by a main body so as to be stored and expanded;

a side guide on which a side guide surface opposing to an end face of a medium placed on the tray is formed, wherein the side guide includes:

a side guide main body that is supported by the tray; and a movable member that is supported by the side guide main body so as to be stored and expanded;

a lifting member that is rotatably supported by the side guide main body; and an elastic member that applies an elastic force to the lifting member such that the lifting member is expanded, wherein a height of the movable member relative to the tray is i) equal to a first height that is higher than a height of the side guide main body relative to the tray when the movable member is expanded, and ii) equal to a second height that is lower than the first height when the movable member is stored, wherein a notch is formed on the movable member such that a depression is formed on the side guide surface when the movable member is expanded, wherein the movable member includes:

a supporting portion that is rotatably supported by the side guide main body; and a protrusion portion that is fixed to the supporting portion, wherein an inside notch side guide surface opposing to the end face is formed on the supporting portion, wherein the notch is formed as a result of the protrusion portion protruding from the inside notch side guide surface, wherein a placement surface of the tray opposing to the medium opposes to the main body when the tray is stored, wherein the movable member is i) expanded, when the lifting member is expanded, as a result of the lifting member lifting the supporting portion, and ii) stored, when the tray is stored, as a result of the protrusion portion coming into contact with the main body, wherein the lifting member is stored against the elastic force, when the movable member is stored, as a result of the supporting portion pushing down the lifting member, and wherein another side guide surface that is along a plane which the side guide surface is along is formed on the lifting member.

* * * * *